US008973790B2

(12) United States Patent
Boisdequin et al.

(10) Patent No.: US 8,973,790 B2
(45) Date of Patent: Mar. 10, 2015

(54) INNER NOZZLE FOR TRANSFERRING MOLTEN METAL CONTAINED IN A METALLURGICAL VESSEL AND DEVICE FOR TRANSFERRING MOLTEN METAL

(75) Inventors: Vincent Boisdequin, Naast (BE); Mariano Collura, Bracquengnies (BE); Fabrice Sibiet, Colleret (FR)

(73) Assignee: Vesuvius Crucible Company, Wilmington, DE (US)

( * ) Notice: Subject to any disclaimer, the term of this patent is extended or adjusted under 35 U.S.C. 154(b) by 267 days.

(21) Appl. No.: 13/635,921

(22) PCT Filed: Mar. 17, 2011

(86) PCT No.: PCT/EP2011/001325

§ 371 (c)(1), (2), (4) Date: Sep. 19, 2012

(87) PCT Pub. No.: WO2011/113598

PCT Pub. Date: Sep. 22, 2011

(65) Prior Publication Data

US 2013/0008927 A1 Jan. 10, 2013

(30) Foreign Application Priority Data

Mar. 19, 2010 (EP) ..... 10157127

(51) Int. Cl.

| | |
|---|---|
| ***B22D 41/50*** | (2006.01) |
| ***B22D 41/40*** | (2006.01) |
| ***B22D 41/34*** | (2006.01) |
| ***B22D 41/56*** | (2006.01) |

(52) U.S. Cl.

CPC ..... *B22D 41/40* (2013.01); *B22D 41/34* (2013.01); *B22D 41/56* (2013.01)

USPC ..... 222/600; 222/607

(58) Field of Classification Search

CPC ..... B22D 41/50; B22D 41/502; B22D 41/505

USPC ..... 222/600, 607

See application file for complete search history.

(56) References Cited

U.S. PATENT DOCUMENTS

| | | | | |
|---|---|---|---|---|
| 6,533,147 | B1 | 3/2003 | Boisdequin | |
| 8,740,024 | B2 * | 6/2014 | Steiner et al. | 222/600 |
| 2012/0273532 | A1 * | 11/2012 | Ackermann et al. | 222/600 |

FOREIGN PATENT DOCUMENTS

| | | | |
|---|---|---|---|
| CN | 1330577 | A | 1/2002 |
| EP | 0727268 | A2 | 8/1996 |
| EP | 1454687 | A1 | 9/2004 |
| EP | 1289696 | B1 | 5/2005 |

* cited by examiner

*Primary Examiner* — Scott Kastler

(74) *Attorney, Agent, or Firm* — Thomas Clinton; Donald M. Satina

(57) ABSTRACT

An inner nozzle for casting molten metal from a metallurgical vessel incorporates a substantially tubular portion with an axial through bore, and an inner nozzle plate comprising a bottom flat contact surface and a second surface opposite the bottom contact surface and joining the wall of the tubular portion to the side edges of the plate. The inner nozzle incorporates a metallic casing cladding at least a portion of some or all of the side edges and second surface but not the sliding plane of the inner nozzle plate. The cladding is provided with a metallic bearing surface, facing towards and recessed with respect to the contact surface and extending from the cladded portion of the side edges beyond the perimeter of the contact surface. The bearing surface is defined by the ledges of at least two separate bearing elements distributed around the perimeter of the plate.

14 Claims, 4 Drawing Sheets

INNER NOZZLE FOR TRANSFERRING MOLTEN METAL CONTAINED IN A METALLURGICAL VESSEL AND DEVICE FOR TRANSFERRING MOLTEN METAL

BACKGROUND OF THE INVENTION (1) Field of the Invention

The present invention relates to the art of continuous molten metal casting and more specifically to an inner nozzle with specific means or elements for fixing it to a tube exchange device in a metal casting facility.

(2) Description of the Related Art

In a casting facility, the molten metal is generally contained in a metallurgical vessel, for example a tundish, before being transferred to another container, for example into a casting mould. The metal is transferred from the vessel to the container via a nozzle system provided in the base of the metallurgical vessel, comprising an inner nozzle located at least partly in the metallurgical vessel and coming into tight contact with a sliding transfer plate (or casting plate) located below and outside of the metallurgical vessel and brought into registry with the inner nozzle via a device for holding and replacing plates, mounted under the metallurgical vessel. This sliding plate may be a calibrated plate, a casting tube or a saggar comprising two or more plates. Since all these types of plates are part of a nozzle comprising a plate connected to a tubular section of varying lengths depending on the applications and to distinguish them from valve gates used, e.g., in a ladle, they will be referred to herein as "sliding nozzle", "pouring nozzle", "exchangeable pouring nozzle" or combinations thereof. The pouring nozzle can be used to transfer the molten metal in the form either of a free flow with a short tube, or of a guided flow with a longer, partly submerged casting tube.

An example of a tube exchange device for a casting facility is described in the document EP1289696. To provide tight contact between the inner nozzle and the sliding nozzle, the tube exchange device for holding and replacing pouring nozzles comprises clamping means, intended to clamp down the inner nozzle against the frame of the device, and pressing means, intended to press on the plate of the pouring nozzle, particularly upwards, so as to press the plate against the inner nozzle, and to thus obtain a tight contact.

As described above, the inner nozzle is a fixed element during casting. Therefore, the service life thereof should be at least as long the one of the metallurgical vessel. The pouring nozzle, on the other hand, may be replaced during casting by means of the tube exchange device.

EP1454687 discloses a collector nozzle to be connected to a sliding gate of a gate valve located at the bottom of a ladle, used for pouring molten metal into a tundish. Like the inner nozzle of a tundish, the collector nozzle disclosed in EP1454687 comprises a refractory core comprising a tubular portion and a plate, most of the external surface of the collector nozzle being clad with a metal casing. This is where the similarities between the two types of nozzles end. Indeed, unlike an inner nozzle, subject of the present invention, the collector nozzle of a ladle does not undergo any frictional stresses during use, as it is fixedly attached to a slide gate plate of a slide gate valve. Furthermore, the collector nozzle is hanging at the bottom of the ladle, whilst the inner nozzle rests on the upper portion of the frame of a tube exchange device. The clamping means used for the two types of nozzle consequently differ substantially from one another. In the collector nozzle disclosed in EP1454687, the nozzle is introduced into a first metal cylinder comprising a flange which engages as a bayonet with a second metal cylinder fixed with screws to the lower portion of a slide plate of a slide gate valve. None of the first and second metal cylinders are part of the collector nozzle, and are rather the clamping means used to fix the collector nozzle to the lower surface of the slide gate plate. This clamping solution of a nozzle to a metallurgical vessel is not suitable for clamping an inner nozzle to the upper portion of the frame of a tube exchange device.

The inner nozzle and the plate of the pouring nozzle each comprise, at least in part, a refractory material. One problem lies in that the forces applied by the clamping or pressing means tend to apply stress concentrations on the refractory material. These stress concentrations may damage the brittle refractory material, and form cracks or lead to crumbling.

The present invention aims at providing an inner nozzle in which material quality and integrity will be maintained during the whole service lives of both nozzle and metallurgical vessel.

SUMMARY OF THE INVENTION

The present invention is defined in the appended independent claims. Specific embodiments are defined in the dependent claims. In particular, the present invention concerns an inner nozzle for casting molten metal from a metallurgical vessel, said inner nozzle comprising a) a substantially tubular portion with an axial through bore defining a first direction, and fluidly connecting an inlet opening and an outlet opening, the inner nozzle further comprising b) an inner nozzle plate comprising a bottom flat contact surface enclosed within a perimeter (Pm) and referred to as the sliding plane (Pg), which is substantially normal to said first direction (Z), said contact surface containing the outlet opening, and a second surface opposite the bottom contact surface and joining the wall of the tubular portion to the side edges of the plate, said side edges extending from the bottom contact surface to the second surface and defining the perimeter and thickness of the plate, the inner nozzle further comprising c) a metallic casing cladding at least a portion of some or all of the side edges and second surface but not the sliding plane (Pg) of the inner nozzle plate and provided with d) a metallic bearing surface, facing towards and recessed with respect to the sliding plane (Pg) and extending from the cladded portion of the side edges beyond the perimeter (Pm) of the contact surface, characterised in that the bearing surface is defined by the ledges of at least two separate bearing elements distributed around the perimeter of the plate.

In a specific embodiment, the ledges of the at least two bearing elements have a length (L) and a width (I), each having a dimension of at least 5 mm, or at least 10 mm, in order to give sufficient stability to the inner nozzle when clamped on the upper portion of the frame of a tube exchange device. In another specific embodiment, the height of the bearing element is at least 10 mm.

The tightness of the interface between inner nozzle and sliding pouring nozzle is enhanced if the bearing surface is defined by the ledges of three separate bearing elements, distributed around the perimeter of the plate and wherein the centroids of the orthogonal projections onto the sliding plane ($P_g$) of the respective ledges form the vertices of a triangle. Said triangle is preferably defined by one or any combination of any of the following geometries:

a) a first altitude of the triangle, referred to as X-altitude, passing through a first vertex, referred to as X-vertex, is substantially parallel to a first axis (X)

b) a first median of the triangle referred to as X-median, passing through the X-vertex, is substantially parallel to said first axis (X)

c) a triangle such that either the X-altitude or the X-median intercepts the central axis (Z) of the nozzle through bore at the through bore centroid (46).

d) all the angles of the triangle are acute;

e) the triangle is isosceles, specifically according to (c), more specifically according to (c) such that the X-vertex is the meeting point of the two sides of equal length, most specifically according to (c), and (d);

f) A triangle according to (c) wherein the angle, $2\alpha$, formed by the through bore centre (46) and the two vertices of the triangle other than the X-vertex is comprised between 60 and 90°, g) A triangle wherein the angle formed by the X-vertex is smaller than 60°.

In a specific embodiment, the bearing ledge corresponding to the X-vertex spans an angular sector, $\gamma$, comprised between 14 and 52°, and the other two bearing ledges span an angular sector, $\beta$, between 10 and 20°, all angles measured with respect to the through bore centroid. The outer ridge of the bearing ledge corresponding to the X-vertex may have a tangent intercepting perpendicularly the first axis (X).

The orthogonal projection onto the sliding plane of the plate of an inner nozzle according to the present invention is more specifically inscribed in a rectangle, with two pairs of opposed edges as follows: two longitudinal edges, substantially parallel to the direction (X), and two transverse edges, substantially normal to the X-direction, none of the at least two bearing elements being provided on the longitudinal edges of the casing. The plate projection may comprise other edges transverse (not necessarily normal) to the X-direction, with rounded corners, or with cut off angles. The bearing elements can of course be located on such transverse, non normal edges of the plate.

In one embodiment, the bearing ledges of all the bearing elements lie on a same plane, substantially parallel to the sliding plane ($P_g$). Inversely, the bearing ledges may lie on different planes, depending on the geometry of the support surfaces designed for receiving said bearing ledges on the upper portion of the tube exchange device. Bearing ledges lying on different planes may be useful in case the inner nozzle must be positioned with a specific angular orientation, as it would tilt in case the bearing ledges were laid onto the wrong support surfaces. It is also possible that the bearing ledges are not parallel to the sliding surface of the inner nozzle. A certain slope may help centring the inner nozzle in its nest on the tube exchange device. In all cases, the design of the inner nozzle bearing ledges must mate the support surfaces of the tube exchange device.

The bearing elements are preferably in the form of a metallic bearing protrusion extending out of the plate perimeter comprising a bearing ledge and an opposed, clamping surface suitable for receiving a clamping means in the inner nozzle receiving portion of a tube exchange device, In one embodiment, the bearing ledge of a bearing protrusion is separated from the opposed clamping surface by refractory sandwiched between two metal layers. The metal layers of the bearing ledge and the clamping surface take all the compressive stresses from the clamping means and support surface of the tube exchange device, and distribute it evenly to the intermediate refractory portion, absorbing and attenuating all stress concentrations. Similarly, upon change of a pouring nozzle, severe shear stresses are applied to the contact surface of the inner nozzle, and these are absorbed by the metal layers. In other words, the compressive stresses from the clamping means or elements do not affect the useful part of the refractory material which is contained within the perimeter pm.

In yet another embodiment, the bearing ledge of a bearing protrusion may be separated from the opposed clamping surface by metal only. In this embodiment, all the compressive stresses generated by the clamping of the inner nozzle in its position are born by metal, and the refractory material is not affected at all by any of these stresses.

Inner nozzles according to the present invention are manufactured by cladding part of a refractory core, in particular portions of the plate, with a metallic casing, comprising the bearing ledges. The present invention therefore also concerns a metallic casing for cladding at least a portion of some or all of the second surface and side edges of the nozzle plate of an inner nozzle as defined above, wherein said metallic casing comprises a first main surface with an opening for accommodating the nozzle's tubular portion and side edges extending from the perimeter of the first main surface, said side edges supporting a bearing surface, characterized in that the bearing surface is defined by the ledges of at least two separate bearing elements distributed around the perimeter of the casing.

The present invention also concerns the assembly of an inner nozzle and a tube exchange device for holding and replacing sliding pouring nozzles for casting molten metal from a metallurgical vessel, the inner nozzle comprising a bearing surface, and the device comprising a frame with a casting opening comprising a support surface adjacent the perimeter of said casting opening, and suitable for receiving and contacting the bearing surface of the nozzle, a clamping system facing the support surface and arranged to press on a surface opposite the bearing surface of the inner nozzle referred to as the clamping surface, characterised in that the bearing surface of the inner nozzle is metallic. Specific embodiments of the inner nozzle are as defined supra.

BRIEF DESCRIPTION OF THE FIGURES

The invention will be understood more clearly on reading the following description, merely given as a non-limitative example of the scope of the invention, with reference to the figures, wherein:

FIG. 2(*a*) is an enlarged view of a bearing element;

DETAILED DESCRIPTION OF THE INVENTION

Figure 1:
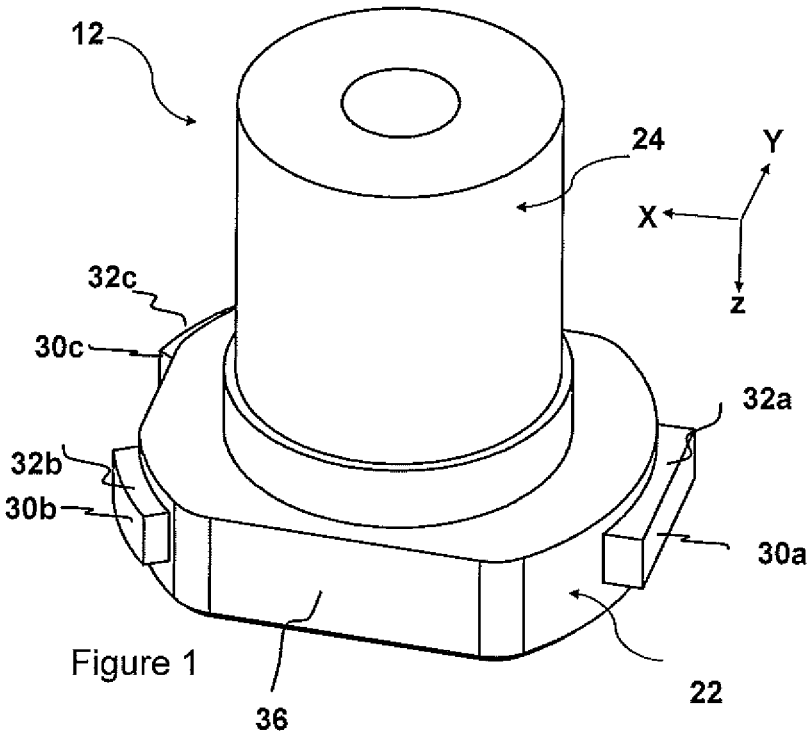
FIG. 1 is a perspective view of an inner nozzle according to one embodiment, in its casting orientation.

The present invention relates to an inner nozzle for casting molten metal contained in a metallurgical vessel, such as a tundish, the casting direction defining a vertical direction. The inner nozzle comprises refractory core partially clad with a metal casing. The refractory core comprises a hollow tubular portion attached to a plate with a through bore extending from one end of the tubular portion to a bottom contact surface of the plate, extending along a substantially horizontal plane referred to as the sliding plane. The inner nozzle is to be fixed vertically with its contact surface oriented downwards to the upper side portion of a tube exchange device. The sliding plane is intended to come into tight contact with the sliding plate of an exchangeable pouring nozzle moved by sliding along the lower side portion of the tube exchange device into a casting position opposite the inner nozzle. The inner nozzle further comprises a metallic casing, cladding at least a portion of the side edges of the inner nozzle plate. The metal casing comprises a bearing surface distributed among at least two separate bearing elements 30*c*, 30*b*, 30*c* for resting on a mating support surface of the frame of the tube exchange device. Said frame further comprises a clamping element or clamping means suitable for applying a compressive force onto a clamping surface 32*a*, 32*b*, 32*c* of the inner nozzle bearing elements, said clamping means or element being opposite to the bearing surface 34*a*, 34*b*, 34*c*. According to the present invention, the bearing surface 34*a-c* and clamping surface 32*a-c* of the inner nozzle are made of metal, so that there are only metal-metal contacts between the frame, clamping means or element and bearing elements, thus allowing to dissipate and distribute any stress concentrations originating from the clamping means or element.

It is thus proposed to save the refractory material of the inner nozzle, by providing that the surface of the inner nozzle resting on the frame is made of metal rather than a refractory material. As a result, when a clamping system presses onto the inner nozzle to press against the frame, a metallic surface is exposed to the stress concentrations induced by the clamping means or element. Since metal is less brittle than the refractory core, cracks are less likely to happen, which means less risk of air infiltrations, metal melt leaks, the service life of the inner nozzle can thus be substantially prolonged, and the cast metal quality is improved. It is preferred that the bearing plane be sufficiently recessed with respect to the sliding plane, so that the wear of the bottom contact surface, made of refractory material, does not affect the clamping of the inner nozzle in the frame.

The metal casing can be made of any metal suitable for fulfilling its function, and is preferably steel or cast iron. In particular if made of cast iron, the metal casing can be as thick as 6 mm and greater. It is thus possible to obtain relatively complex casing shapes while retaining acceptable production costs. In most cases, the metal casing can be used again to clad a second inner nozzle refractory core, when the first one is worn.

The metal bearing surface described above, is defined by the bearing ledges 34*a-c* of at least two bearing elements 30*a-c*. Each ledge should have a sufficient area so that the inner nozzle can steadily rest on the frame. For example, the thickness of the metal casing of a conventional inner nozzle cannot be considered as a bearing surface, because its thickness rarely exceeds 2 or 3 mm, which is insufficient to hold an inner nozzle in place, in particular when a new pouring nozzle is slid into casting position, thus generating high shear stresses.

In the present application, the expression inner nozzle "clamping system" of a tube exchange device refers to the combination of clamping element 50*a-c*, with an opposite support surface 80*a-c* designed to clamp in place mating bearing elements 30*a-c* of an inner nozzle, with the bearing ledges 34*a-c* thereof, resting on the support surfaces. The clamping elements apply a compressive force onto a clamping surface 32*a-c* of the bearing elements, which are opposite the bearing ledges 34*a-c*.

The inner nozzle may further comprise one or a plurality of the following features, alone or in combination.

The bearing surface projects from a peripheral surface of the inner nozzle plate. The term "peripheral surface" refers to the surface extending from the periphery of the bottom plate contact surface, preferably in a substantially vertical direction. The nozzle comprises at least two separate bearing elements 30*a-c*, each comprising a bearing ledge 34*a-c*. The term "separate" refers to distinct, non-adjacent surfaces. They may for example be separated from each other by a gap or by a rib.

The bearing ledges each have a length and a width, greater than 5 mm, preferably greater than or equal to 10 mm. The bearing ledges thus have sufficient area for securing the nozzle resting on the frame in its casting position.

The nozzle may comprise three, and only three, separate bearing ledges 34*a-c*. This configuration confers a high stability to the inner nozzle, with an even pressure distributed on each bearing element by the clamping means or element, like the well known three legs stand for chairs or tables, which are more stable than four leg stands. With more than three bearing ledges, clamping may be unsatisfactory in case of small defects in their alignment In a certain embodiment a vertical central longitudinal plane of the inner nozzle can be defined, comprising the central Z-axis of the inner nozzle through bore, and the three bearing ledges 34*a-c* are arranged on a plane normal to said vertical central longitudinal plane forming a Y shape on the periphery of the metallic casing, the base of the Y being arranged in said longitudinal plane and both arms of the Y being arranged on either sides of said plane, meeting at the centroid of the inner nozzle contact surface. In certain embodiments, both arms of the Y are symmetrical in relation to the central plane. This Y-shaped arrangement of the bearing ledges 34*a-c* yields particularly satisfactory nozzle clamping stability, while limiting the space requirements of the clamping system and using a particularly simple clamping method. It should be noted that, for a symmetrical inner nozzle, wherein the casting orifice is arranged at the centroid of the contact or sliding surface, the centroid of the inner nozzle plate corresponds to the centroid of the inner nozzle through bore. On the other hand, for an asymmetrical nozzle, for example having a rectangular general shape and wherein the casting channel is not arranged at the centroid of the contact surface, the centroid of the inner nozzle contact surface is different from the centroid of the through bore.

The metallic casing comprises a main surface with an opening for accommodating the tubular section of the nozzle and side edges extending from the perimeter of the main surface, Generally, the perimeter of the main surface can be circumscribed by a rectangle with two longitudinal edges and two normal edges, the longitudinal direction being defined by the plate replacement direction in the device when the inner nozzle is clamped in its casting position. The longitudinal and normal edges may join in right angles, or they may be connected by a rounded corner or a broken angle. In a preferred embodiment, the bearing ledges 34*a-c* are provided only on the transverse edges of the casing, i.e., the normal edges, or the edges connecting the normal edges to the longitudinal edges. It is advantageous to arrange the bearing ledges 34*a-c* in directions transverse to the longitudinal direction, because the pressing means or elements located on the lower side portion of the tube exchange device, which press on the plate of the exchangeable pouring nozzle against the sliding surface of the inner nozzle are generally arranged along the longitudinal direction. By disposing the bearing ledges transverse to the pressing means or elements, a more homogeneous compressive pressure distribution is applied throughout the interface between the two sliding planes of the inner nozzle and pouring nozzle.

Figure 2:
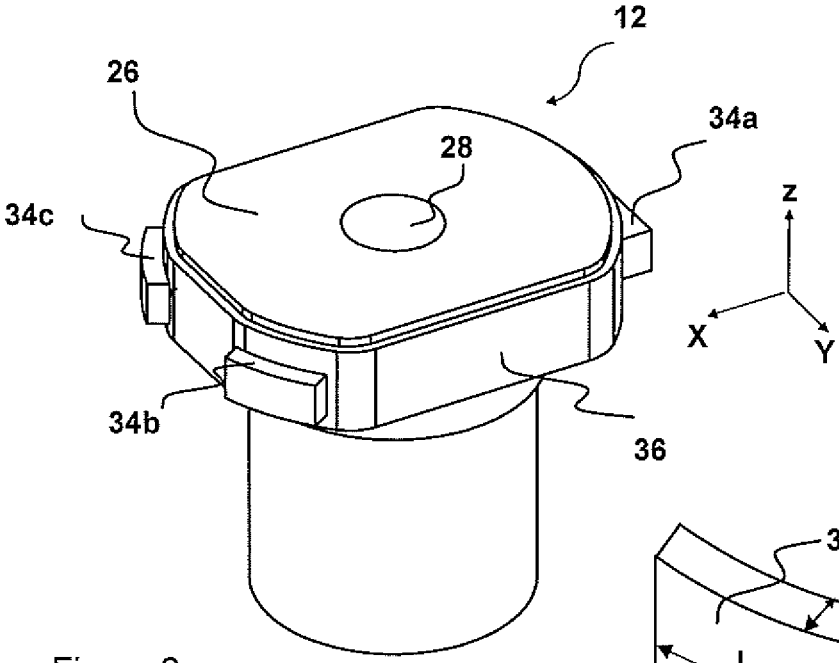
FIG. 2 is a perspective view of the nozzle of FIG. 1 when it is turned up side down in the vertical direction.
Figure 2A:
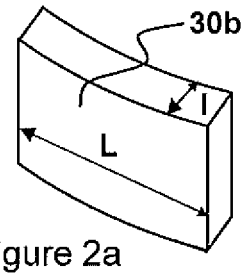

The nozzle comprises at least two bearing elements for clamping the inner nozzle against a support surface of the frame of a tube exchange device. Each bearing element 30*a-c* is part of the metallic casing and comprises:

a bearing ledge 34*a-c;* and a clamping surface 32*a-c*, opposite the bearing ledge, and onto which a clamping element is intended to apply a clamping force. The clamping surface 32*a-c* can be part of the main surface of the casing, or it can be separated therefrom as illustrated in FIGS. 1 and 2.

The bearing element is preferably entirely made of metal, with only metal between the bearing ledge 34*a-c* and the clamping surface 32*a-c*. In this embodiment, only the metal supports the clamping stresses, which saves the refractory material of the inner nozzle. Alternatively, the metal surfaces of the bearing ledge and clamping surface of a bearing element may be separated by a non-metallic material such as refractory. In this embodiment, the metal layers of the bearing elements support all the stress concentrations associated with the clamping means or element and redistribute them more evenly to the refractory core, which has good compressive resistance.

Upon clamping the inner nozzle to the frame of the tube exchange device, the nozzle bearing elements are sandwiched between the frame support surface and the clamping system.

The bearing ledges or the clamping surfaces of the nozzle bearing element may be plane. Alternatively, these surfaces may have various shapes, for example, inclined, convex, concave, structured or grooved. The bearing ledges or the clamping surfaces may extend in a plane substantially parallel to the contact surface 26. Preferably, the bearing ledges or clamping surfaces are coplanar, preferably parallel to the contact surface 26. It is important that the surfaces are suitable for fulfilling their function, in terms of geometry, resistance, thickness, and the like. The geometry of the bearing elements 30*a-c* must mate the clamping elements and support surface of the tube exchange device they are to be mounted on. Additional elements such as fibres, a seal or a compressible element could be added to the bearing ledges or clamping surfaces, by any means known in the art (glue, mechanical fastening, embedded, etc.).

The invention also relates to a metallic casing for an inner nozzle as described above, along with a method for producing an inner nozzle as described above, comprising the step of assembling a metallic casing and a refractory element.

The invention also relates to an assembly of an inner nozzle and a tube exchange device for holding and replacing sliding pouring nozzles for casting molten metal from a metallurgical vessel, the inner nozzle comprising a metallic casing, the device comprising a frame, which upper portion is in contact with at least one bearing surface of the nozzle, and a clamping system facing the upper section of the frame, arranged to press onto a clamping surface of the inner nozzle, wherein the inner nozzle bearing surface is provided on the metallic casing and is defined by the bearing ledges 34*a-c* of at least two separate bearing elements 30*a-c*.

As described above, it is proposed that the surface of the inner nozzle resting on the frame is made of metal rather than refractory material. Therefore, when the clamping system presses against the inner nozzle to press same against the frame, a metal-metal contact is established with all the mechanical benefits described above.

Hereinafter, the substantially vertical direction, corresponding to the casting direction, is referred to as the Z-direction, and the central axis of the through bore of the inner nozzle as the Z-axis, which is parallel to the Z-direction when the inner nozzle is mounted in its casting position on the tube exchange device. The longitudinal direction, corresponding to the plate replacement direction, is referred to as the X direction, which is substantially normal to the Z-direction; the X-axis is parallel to the X-direction and passes through the centroid of the casting opening of the tube exchange device.

Figure 3:
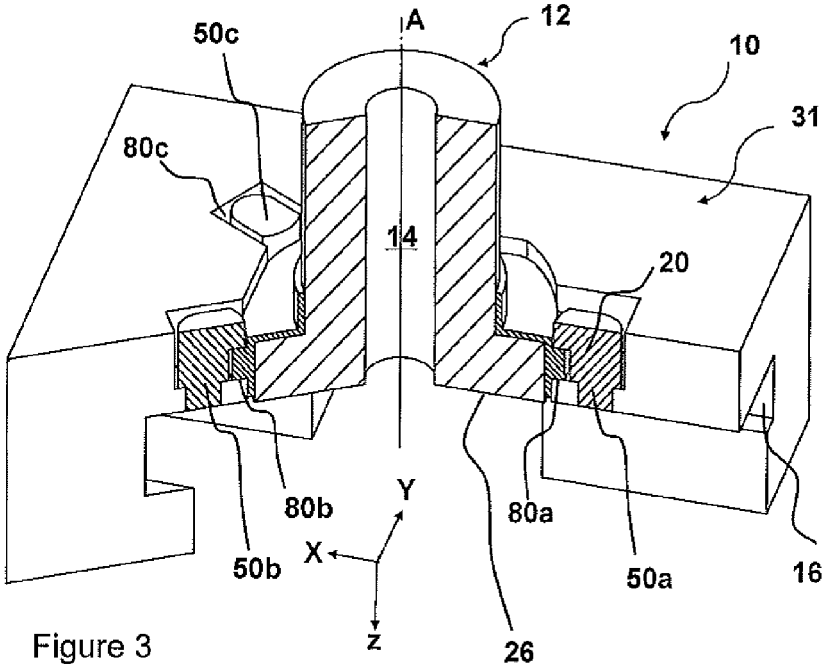
FIG. 3 is a perspective view split along two axial half-planes of the nozzle of FIG. 1 clamped on a tube exchange device.
Figure 4:
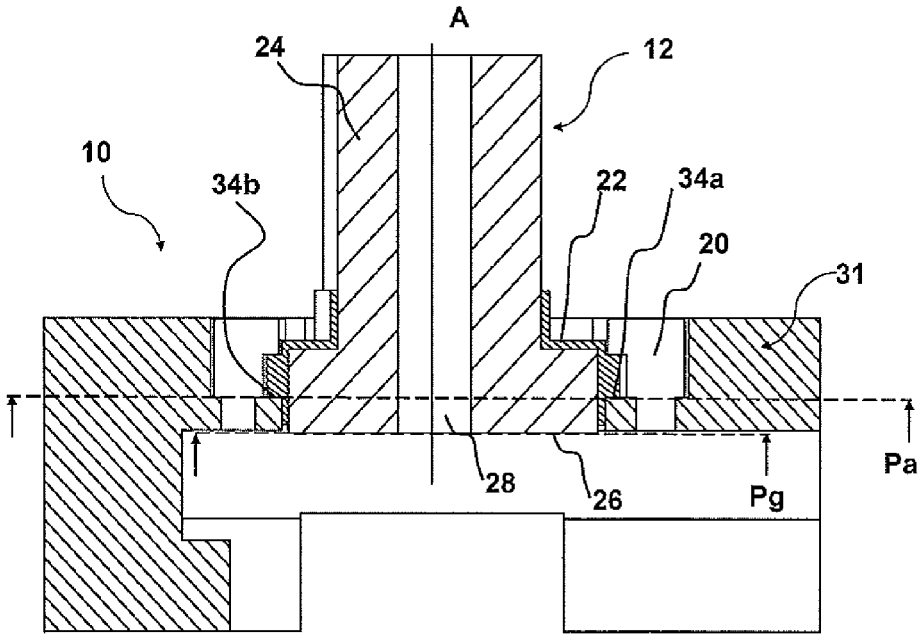
FIG. 4 is a sectional side view along both axial half-planes of FIG. 3.

In a continuous molten metal casting facility, such as for casting molten steel, a tube exchange device 10 for holding and replacing sliding nozzles is used for casting the metal contained in a metallurgical vessel, for example a tundish, to a container, such as one or a plurality of casting moulds. The device 10, partly represented in FIGS. 3 and 4 is mounted under the metallurgical vessel, in registry with an opening in the floor thereof, such as to insert therethrough an inner nozzle 12, fixed to the frame of a tube exchange device 10 and attached to the base of the metallurgical vessel, for example with cement. A side view representation of a typical tube exchange device can be found in FIG. 1 of EP1289696. The through bore 14 of the inner nozzle 12 defines a casting channel and the device 10 is arranged such that it can guide the sliding plate of a pouring nozzle to a casting position, such that the axial bore of the latter comes in fluid communication with the through bore 14 of the inner nozzle. For this purpose, the device 10 comprises guiding elements or means 16 for guiding the sliding nozzle through an inlet and from a standby position to a casting position. For example the guiding means or element can be in the form of guiding rails 16. The rails 16 are arranged along the longitudinal edges of the channel of the device 10 leading from the device inlet, to the idle position and to the casting position, Moreover, at the pouring nozzle casting position, the device 10 comprises pressing elements or means arranged parallel to the X-direction for pressing the plate of the pouring nozzle against the contact surface of the inner nozzle 12, for example compressed springs, said means or element being arranged to apply a force on a bottom surface of each of the two longitudinal edges of the sliding plate of the pouring nozzle, so as to press the plate in tight contact against the contact surface of the inner nozzle 12 and thus to create a fluid tight connection between the through bore 14 of the inner nozzle and the axial bore of the pouring nozzle. The device 10 further comprises means or elements 20 for clamping the inner nozzle, described in more detail below, arranged to apply a force on a top clamping surface (32*a*, 32,*b*, 32*c*) of two edges of the inner nozzle 12, so as to keep the opposite bearing surfaces (34*a*, 34*b*, 34*c*) of the inner nozzle pressing against the support surfaces of the device 10. The term transverse means in the present context, not parallel to, or secant with the X-direction.

Figure 6:
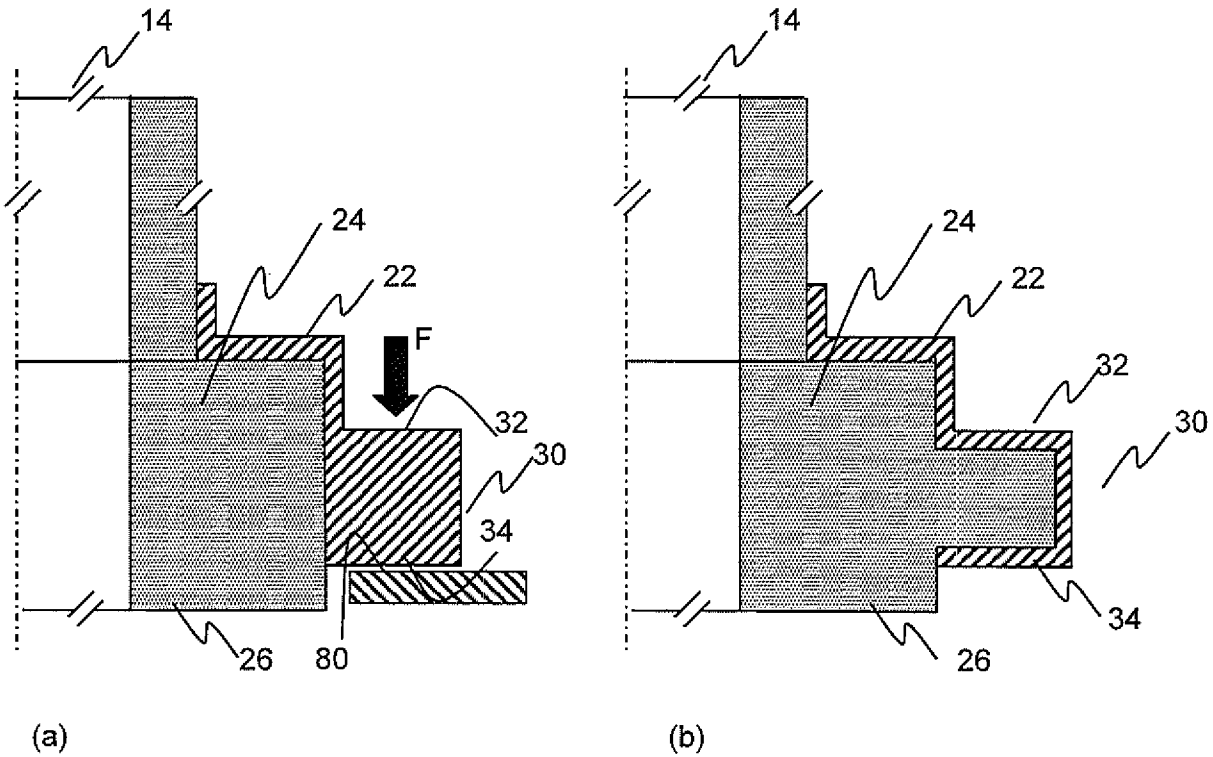
FIG. 6: are two embodiments of bearing elements (a) all metal, (b) refractory sandwiched between two metal layers.

The inner nozzle 12 comprises a metallic casing 22, cladding all but the first, contact surface (26) of the inner nozzle plate 24 made of a refractory material, as can be seen in FIGS. 2 & 6. The metallic casing 22 reinforces the refractory element 24 and is preferably bonded to the plate using cement. The refractory plate is essential to support the high temperatures wherever the nozzle contacts molten metal, but its mechanical properties, in particular shear, friction, and wear resistance are insufficient wherever there is concentration of stresses. For this reason, the refractory plate is clad with a metal casing wherever mechanical stresses are applied but away from any possible contact with molten metal. The thickness of the metal casing may vary from about 1 mm to greater than 6 mm, the thicker walls being generally when the metal casing is made of cast iron. The metallic casing lies clear from the contact surface 26 of the inner nozzle (cf. FIGS. 2 and 6) as the latter is to be brought in intimate contact with the sliding surface of the plate of a pouring nozzle. Metal could not be used for cladding the contact surface because it would be damaged in case of any leak of metal melt with dramatic consequences. As mentioned supra, the contact surface 26 of the inner nozzle is intended to be brought into tight contact with the sliding surface of a pouring nozzle when said nozzle is pushed in place by the device 10 to the casting position, i.e. facing the inner nozzle 12. One end of the inner nozzle through bore 14 opens at the contact surface 26.

The bearing ledges 30*a*, 30*b*, 30*c* are separate and project from a peripheral surface 36 of the plate of the inner nozzle 12, said surface 36 extending from the perimeter pm of the bottom contact surface 26 of the plate, preferably but not necessarily, in a substantially vertical direction Z. In one embodiment, refractory material may extend between the bearing ledge and the clamping surface of a bearing element of the inner nozzle (cf. FIG. 6(*b*)). In this embodiment, a portion of the refractory is exposed to the compression stresses of the clamping means or element 20, but any stress concentration is absorbed and distributed by the metal layer separating the refractory from the clamping means or element and support surfaces of the tube exchange device. In a preferred embodiment, the bearing ledge and opposed clamping surfaces are separated by metal only (cf. FIG. 6(*a*)). This ensures that the clamping force is not applied to the refractory at all, but to metal only. Like in the example illustrated in the figures, the three bearing ledges 30*a*, 30*b*, 30*c* are entirely made of metal, i.e. there is only metal between the bearing surfaces 34*a*, 34*b*, 34*c* and the clamping surfaces 32*a*, 32*b*, 32*c*.

Figure 5:
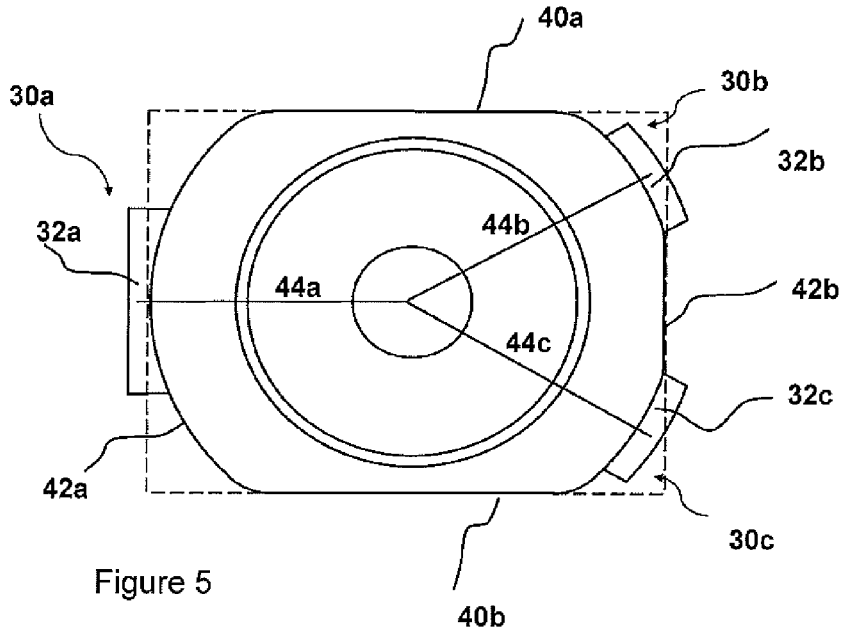
FIGS. 5 and 5*a* are schematic top views of the nozzle of FIG. 1.

As can be seen in FIGS. 5 and 5(*a*), the inner nozzle 12 may have two substantially longitudinal opposite edges 40*a*, 40*b* and two opposite edges: 42*a*, 42*b*, substantially normal to the longitudinal edges. Furthermore, a vertical central longitudinal plane P can be defined by the X-axes and Z-axes and the three bearing elements 30*a*, 30*b*, 30*c* may be arranged in a Y shape on the periphery 36 of the nozzle 12, the base 44*a* of the Y being arranged in the central longitudinal plane P coaxially with the X-axis and the two arms 44*b*, 44*c* of the Y being arranged on either side of said plane P and all arms of the Y meeting at the centroid 46 of the inner nozzle through bore 14 (assuming a symmetrical inner nozzle). More specifically, the second 30*b* and third 30*c* bearing elements have a second 34*b* and a third 34*c* bearing ledges, each of these second 34*b* and third 34*c* bearing ledges being arranged on either side of the longitudinal plane P. In the example described, the second and third bearing ledges are arranged symmetrically, but this is not necessarily the case. Furthermore, each of the orthogonal projections of the bearing ledges 34*b*, 34*c* onto a plane parallel to the contact surface 26 have a centroid 32'*b*, 32'*c* positioned at an angle α (alpha) between 30 and 45° in relation to the longitudinal plane P, with reference to the centroid 46 of the inner nozzle 12, corresponding to the centre of the casting orifice 28. Furthermore, each of the second 34*b* and third 34*c* bearing ledges is included in an angular sector β (beta) between 10 and 20° with reference to the centre 46 of the inner nozzle 12. Moreover, the first bearing element 30*a* has a first bearing ledges 34*a* passing through the longitudinal plane P of the nozzle 12. More specifically, the bearing ledge 34*a* extends substantially symmetrically in relation to the plane P, the centroid 32'*a* of this surface being positioned in the plane P. The bearing ledge 34*a* may extend in a surface included in an angular sector γ (gamma) between 14 and 52° with the reference to the centre 46 of the inner nozzle.

Figure 5A:
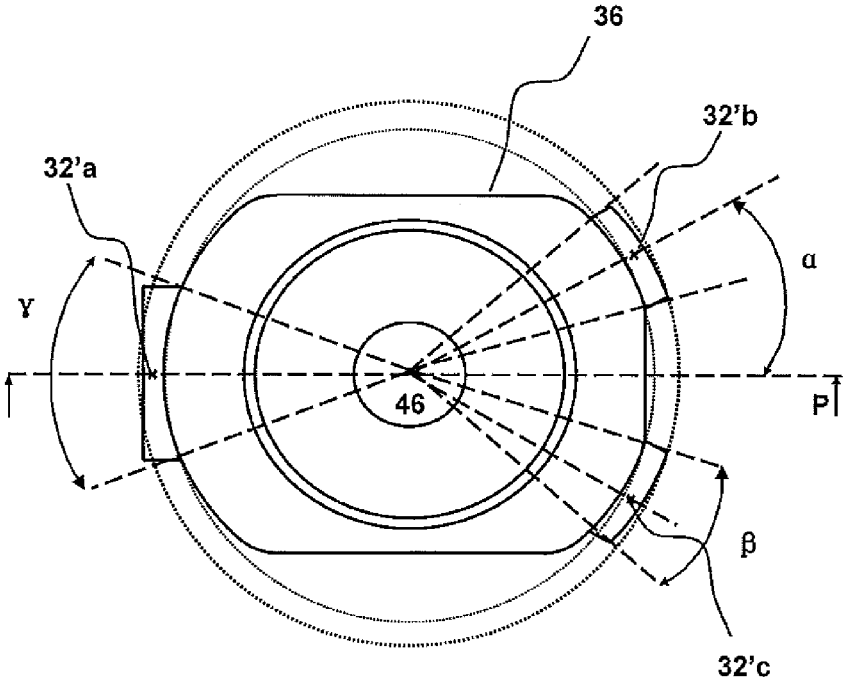

In the embodiments illustrated in the Figures, the bearing elements 30*a*, 30*b*, 30*c*, thus the bearing ledges 34*a*, 34*b*, 34*c* are provided only on the transverse edges 42*a*, 42*b* of the casing. It should be noted that, in the case of an inner nozzle having an overall rectangular shape as illustrated in FIGS. 5 and 5*a*, the central longitudinal plane is the plane perpendicular to the bottom contact surface 26 comprising the median of the two shortest sides of the rectangle circumscribed.

The clamping means or elements 20 of the tube exchange device comprise two clamping elements, in certain embodiments arranged transverse to the X-axis. In a particular embodiment, three clamping elements 50*a*, 50*b*, 50*c*, are arranged in a Y shape at the periphery of the inner nozzle 12 (cf. FIG. 3), i.e. a first clamping element 50*a* at the base of the Y, arranged on the rear portion of the central longitudinal plane P and a second 50*b* and a third 50*c* clamping elements, at the ends of both arms of the Y, arranged on either side of the front portion of said plane P. As can be seen, the clamping means or elements are arranged to apply the force thereof on the transverse edges 42*a*, 42*b* of the inner nozzle. The clamping elements 50*a*, 50*b*, 50*c* have a complementary configuration of the bearing elements 30*a*, 30*b*, 30*c*. In this way, the first 50*a*, second 50*b* and third 50*c* clamping elements respectively apply a clamping force, F, on the first 34*a*, second 34*b* and third 34*c* bearing ledges described above (cf. FIG. 6). The clamping elements 50*a*, 50*b*, 50*c* are movably mounted between an idle position and a clamping position. In the clamping position, the elements 50*a*, 50*b*, 50*c* come into contact with the clamping surfaces 32*a*, 32*b*, 32*c* of the bearing elements 30*a*, 30*b*, 30*c*, so as to apply a clamping force by pressing on these surfaces. For this purpose, the clamping elements 50*a*, 50*b*, 50*c* may be actuated by a rotary device acting as a cam in contact with the elements 50*a*, 50*b*, 50*c*. Optionally, one or a plurality of the elements 50*a*, 50*b*, 50*c* is/are actuated by means of a connecting rod.

As can be seen in FIGS. 3 and 4, when the inner nozzle 12 is coupled to the tube exchange device 10, the bearing ledges 34*a*, 34*b*, 34*c* rest on corresponding support surfaces 80*a*, 80*b*, 80*c* provided on the frame 31. The bearing elements 30*a*, 30*b*, 30*c* are thus sandwiched between the clamping elements 50*a*, 50*b*, 50*c* and the support surfaces 80*a*, 80*b*, 80*c* of the frame. The bearing surface $P_a$ formed by the surfaces 34*a*, 34*b*, 34*c* is preferably vertically recessed in relation to the sliding plane $P_g$, so as to expose the sliding plane upfront, in a position suitable for establishing a tight contact with the sliding plane of a pouring nozzle. In the example, the bearing ledges 34*a*, 34*b*, 34*c* are the bottom surfaces of the bearing elements and the clamping system applies a force, particularly downward, on the top, clamping surfaces 32*a*, 32*b*, 32*c* of the bearing elements. However, the bearing ledges and clamping surfaces could be inverted with a clamping system applying a particularly upward force. The inner nozzle would thus be clamped upwards applying a particularly upward force. Also in this embodiment, the bearing elements 30*a*, 30*b*, 30*c* may be sandwiched between a clamping element and a support surface.

As illustrated in FIG. 6, the bearing elements are preferably in the form of a metallic bearing protrusion extending out of the plate perimeter comprising a bearing ledge and an opposed, clamping surface suitable for receiving a clamping means or element in the inner nozzle receiving portion of a tube exchange device, In one embodiment illustrated in FIG. 6(*b*), the bearing ledge of a bearing protrusion is separated from the opposed clamping surface by refractory sandwiched between two metal layers. The metal layers of the bearing ledge and the clamping surface absorb the compressive stresses from the clamping means or element and support surface of the tube exchange device, and distribute it evenly to the intermediate refractory portion, absorbing and attenuating all stress concentrations. Similarly, upon change of a pouring nozzle, severe shear stresses are applied to the contact surface of the inner nozzle, and these are absorbed by the metal layers.

In another embodiment illustrated in FIG. 6(*a*), the bearing ledge of a bearing protrusion may be separated from the opposed clamping surface by metal only. In this embodiment, all the compressive stresses generated by the clamping of the inner nozzle in its position are born by metal, and the refractory material is not affected at all by any of these stresses. With this embodiment, the service life of the refractory is substantially prolonged.

Among the benefits of the nozzle 12 used with a tube exchange device 10 as described above, it should be noted that the bearing ledges 34*a*, 34*b*, 34*c* made of metal and being part of the metallic casing wear less rapidly than if they were made of a refractory material 24, and they are less likely to crack or crumble under the effect of stress concentrations.

In particular, the invention relates to an inner nozzle of a device for holding and replacing plates, for example a device for replacing tubes or for replacing calibrated plates. The nozzle according to the invention may also be used in a device for holding and replacing plates wherein, for example, a cassette comprising two or more plates is moved by sliding opposite a casting orifice of a metallurgical vessel.

Another advantage of the present invention is that the same metallic casing 22 can be used again to clad a second refractory element 24.

The inner nozzle could also consist of a plurality of refractory elements assembled together before use. In particular, the nozzle plate and the tubular portion thereof may be two separate elements.

Numerous modifications and variations of the present invention are possible. It is, therefore, to be understood that within the scope of the following claims, the invention may be practiced otherwise than as specifically described.

10 Device for holding and replacing plates
12 Inner nozzle
16 Guiding means
20 Clamping system
22 Metallic casing
26 Bottom contact surface
28 Outlet opening
30*a*, 30*b*, 30*c* Bearing element
31 Frame
32*a*, 32*b*, 32*c* Clamping surface
34*a*, 34*b*, 34*c* Bearing surface (bearing ledge)
36 Peripheral surface
40*a*, 40*b* Longitudinal edges
42*a*, 42*b* Transverse edges
80*a*, 80*b*, 80*c* support surface of the device
Pa Bearing plane
Pg Sliding plane
X Plate replacement direction
Y Transverse direction
Z Casting direction

We claim:

1. Inner nozzle for casting molten metal from a metallurgical vessel, said inner nozzle comprising a) a substantially tubular portion with an axial through bore defining a first direction (Z), and fluidly connecting an inlet opening and an outlet opening, the inner nozzle further comprising b) an inner nozzle plate comprising a bottom flat contact surface enclosed within a perimeter (Pm) and referred to as the sliding plane (Pg), which is substantially normal to said first direction (Z), said contact surface containing the outlet opening, and a second surface opposite the bottom contact surface and joining the wall of the tubular portion to the side edges of the plate, said side edges extending from the bottom contact surface to the second surface and defining the perimeter and thickness of the plate, the inner nozzle further comprising c) a metallic casing cladding at least a portion of some or all of the side edges and second surface but not the sliding plane (Pg) of the inner nozzle plate and provided with d) a metallic bearing surface, facing towards and recessed with respect to the sliding plane (Pg) and extending from the cladded portion of the side edges beyond the perimeter (Pm) of the contact surface, wherein the bearing surface is defined by the ledges of at least two separate bearing elements distributed around the perimeter of the plate.

2. Nozzle according to claim 1, wherein the ledges of the at least two bearing elements have a length (L) and a width (I), each having a dimension of at least 5 mm.

3. Nozzle according to claim 1, wherein the bearing surface is defined by the ledges of three separate bearing elements, distributed around the perimeter of the plate and wherein the centroids of the orthogonal projections onto the sliding plane (Pg) of the respective ledges form the vertices of a triangle.

4. Nozzle according to claim 3, wherein the triangle formed by the centroids of the three bearing ledge projections is defined by at least one geometry selected from the group consisting of the following:

a) a first altitude of the triangle, referred to as X-altitude, passing through a first vertex, referred to as X-vertex, is substantially parallel to a first axis (X)

b) a first median of the triangle referred to as X-median, passing through the X-vertex, is substantially parallel to said first axis (X)

c) a triangle such that either the X-altitude or the X-median intercepts the central axis (Z) of the nozzle through bore at the through bore centroid d) all the angles of the triangle are acute;

e) the triangle is isosceles;

f) a triangle according to (c) wherein the angle, $2\alpha$, formed by the through bore centre and the two vertices of the triangle other than the X-vertex is comprised between 60 and 90°, g) a triangle wherein the angle formed by the X-vertex is smaller than 60°.

5. Nozzle according to claim 4, wherein the triangle formed by the centroids of the three bearing ledge projections has the geometry of a triangle such that either the X-altitude or the X-median intercepts the central axis (Z) of the nozzle through bore at the through bore centroid, and wherein the bearing ledge corresponding to the X-vertex spans an angular sector, $\gamma$, comprised between 14 and 52°, and the other two bearing ledges span an angular sector, $\beta$, between 10 and 20°, all angles measured with respect to the through bore centroid.

6. Nozzle according to claim 4, wherein the triangle formed by the centroids of the three bearing ledge projections has the geometry of a triangle such that either the X-altitude or the X-median intercepts the central axis (Z) of the nozzle through bore at the through bore centroid, and wherein the outer ridge of the bearing ledge corresponding to the X-vertex has a tangent intercepting perpendicularly the first axis (X).

7. Nozzle according to claim 1, wherein the metallic casing comprises two pairs of opposed edges as follows: two longitudinal edges and two transverse edges, none of the at least two bearing elements being provided on the longitudinal edges of the casing.

8. Nozzle according to claim 1, wherein the bearing ledges of all the bearing elements lie on a same plane, substantially parallel to the sliding plane (Pg).

9. Nozzle according to claim 1, wherein at least one of the bearing elements is in the form of a metallic bearing protrusion extending out of the plate perimeter comprising a bearing ledge and an opposed, clamping surface.

10. Nozzle according to claim 9, wherein the bearing ledge of the at least one bearing protrusion is separated from the opposed clamping surface by metal only.

11. Nozzle according to claim 9, wherein the bearing ledge of the at least one bearing protrusion is separated from the opposed clamping surface by refractory sandwiched between two metal layers.

12. Metallic casing for cladding at least a portion of some or all of the second surface and side edges of the nozzle plate of an inner nozzle according to claim 1, wherein said metallic casing comprises a first main surface with an opening for accommodating the nozzle's tubular portion and side edges extending from the perimeter of the first main surface, said side edges supporting a bearing surface, wherein the bearing surface is defined by the ledges of at least two separate bearing elements distributed around the perimeter of the casing.

13. Assembly of an inner nozzle according to claim 1 and a tube exchange device for holding and replacing sliding pouring nozzles for casting molten metal from a metallurgical vessel, the inner nozzle comprising a bearing surface, and the device comprising a frame with a casting opening comprising a support surface adjacent the perimeter of said casting opening, and configured to receive and contact the bearing surface of the inner nozzle, a clamping system facing the support surface and arranged to press on a surface opposite the bearing surface of the inner nozzle referred to as the clamping surface, wherein the bearing surface of the inner nozzle is metallic.

14. Method for producing an inner nozzle according to claim 1 comprising the step of assembling (a) a metallic casing comprising a first main surface with an opening for accommodating the nozzle's tubular portion and side edges extending from the perimeter of the first main surface, said side edges supporting a bearing surface, wherein the bearing surface is defined by the ledges of at least two separate bearing elements distributed around the perimeter of the casing; and (b) a refractory plate element of an inner nozzle.

* * * * *